US007755344B2

(12) United States Patent
Hsieh

(10) Patent No.: US 7,755,344 B2
(45) Date of Patent: Jul. 13, 2010

(54) ULTRA LOW-VOLTAGE SUB-BANDGAP VOLTAGE REFERENCE GENERATOR

(75) Inventor: Chen-Hui Hsieh, Chu-Pei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 266 days.

(21) Appl. No.: 11/779,257

(22) Filed: Jul. 17, 2007

(65) Prior Publication Data

US 2009/0021234 A1 Jan. 22, 2009

(51) Int. Cl.
*G05F 3/16* (2006.01)

(52) U.S. Cl. ..... 323/315

(58) Field of Classification Search ..... 323/282–286, 323/312–316; 327/77, 78, 530–535, 542, 327/543

See application file for complete search history.

(56) References Cited

U.S. PATENT DOCUMENTS 5,637,993 A * 6/1997 Whitney et al. ..... 323/315
2007/0069709 A1 3/2007 Jeong et al.

* cited by examiner

*Primary Examiner*—Rajnikant B Patel
(74) *Attorney, Agent, or Firm*—K&L Gates LLP

(57) ABSTRACT

A low-voltage sub-bandgap reference circuit is disclosed. In one embodiment, the low-voltage sub-bandgap voltage reference circuit includes a differential amplifier and a first bipolar transistor with its base and collector coupled to an electrical ground. The reference circuit further includes a second bipolar transistor with base and collector coupled to the electrical ground. The reference circuit further includes a DC bias circuit supplying a predetermined voltage output between a high and low voltage terminal, the high voltage terminal being coupled to both collectors of the first and second bipolar transistors and the low voltage terminal being coupled to both bases of the first and second bipolar transistors.

20 Claims, 4 Drawing Sheets

ULTRA LOW-VOLTAGE SUB-BANDGAP VOLTAGE REFERENCE GENERATOR

BACKGROUND

The present invention generally relates to integrated circuit (IC) designs, and more particularly to a sub-bandgap reference voltage generator design.

The increase demand for portable devices and the technology scaling are driving down the supply voltages of digital circuits. Voltage reference generator is one of essential building blocks of many integrated circuits (ICs). The bandgap reference generators which can operate from 1V supply are widely used in DRAM and flash memories. A bandgap voltage reference must be, at least inherently, well-defined and insensitive to temperature, power supply and load variations.

The principle of the bandgap circuits relies on two groups of diode-connected bipolar junction transistors (BJT) running at different emitter current densities. By canceling the negative temperature dependence of the PN junctions in one group of transistors with the positive temperature dependence from a PTAT (proportional-to-absolute-temperature) circuit which includes the other group of transistors, a fixed DC voltage output, Vref, which doesn't change with temperature is generated. This voltage is typically 1.26 volts, which is approximately the bandgap of silicon.

An early attempt for the solution is a conventional bandgap reference circuit that uses conventional bipolar technology to create a stable low reference voltage at around 1.2 volts as described above. However, as IC design is now predominated by low power and low voltage objectives, recent IC design typically requires sub-1 volt operation regions. While some conventional bandgap reference circuits can operate at slightly below 1 volt, most of the known conventional bandgap reference circuits are not suitable for a supply voltage lower than 0.9 V.

Accordingly, it is desirable to provide an improved low-voltage sub-bandgap voltage reference circuit that can operate at or below 0.9 volt supply voltage. Furthermore, other desirable features and characteristics of the present invention will become apparent from the subsequent detailed description and the appended claims, taken in conjunction with the accompanying drawings and the foregoing technical field and background.

SUMMARY

In view of the foregoing, embodiments of the present invention provide a low-voltage sub-bandgap voltage reference generator circuit configured to operate at or below 0.9 volt supply voltage without sacrificing other electrical or temperature characteristics.

In one embodiment, the low-voltage sub-bandgap voltage reference circuit includes a differential amplifier and a first bipolar transistor with its emitter coupled to a negative input terminal of the differential amplifier and its base and collector coupled to an electrical ground. The sub-band gap voltage reference circuit further includes a second bipolar transistor with its emitter coupled to a positive input terminal of the differential amplifier and its base and collector coupled to the electrical ground and a bandgap reference voltage output module for outputting a bandgap reference voltage. The reference circuit further includes a DC bias circuit supplying a predetermined voltage output between a high and low voltage terminal, the high voltage terminal being coupled to both collectors of the first and second bipolar transistors and the low voltage terminal being coupled to both bases of the first and second bipolar transistors to improve the low VDD characteristic.

In another embodiment, the low-voltage sub-bandgap voltage reference circuit includes a differential amplifier and a first bipolar transistor with its emitter coupled to a negative input terminal of the differential amplifier and its base and collector coupled to an electrical ground. The low-voltage sub-bandgap voltage reference circuit further includes a second bipolar transistor with its emitter coupled to a positive input terminal of the differential amplifier and its base and collector coupled to the electrical ground. In addition, the reference circuit includes a first PMOS transistor with its drain coupled to the negative input terminal and its gate coupled to an output terminal of the differential amplifier. The sub-bandgap voltage reference circuit further includes a second PMOS transistor with its drain coupled to the positive input terminal and its gate coupled to the output terminal of the differential amplifier. Moreover, the reference circuit further includes a DC bias circuit supplying a predetermined voltage output between a high and low voltage terminal, the high voltage terminal being coupled to both collectors of the first and second bipolar transistors and the low voltage terminal being coupled to both bases of the first and second bipolar transistors to improve the low VDD characteristic.

The features and advantages described in the specification are not all inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

A more complete understanding of the present invention may be described by referring to the detailed description and claims when considered in conjunction with the following figures, wherein like reference numbers refer to similar elements throughout the figures.

DESCRIPTION

The present invention will now be described in detail with reference to a various embodiments thereof as illustrated in the accompanying drawings. In the following description, specific details are set forth in order to provide a thorough understanding of the present invention.

Figure 1:
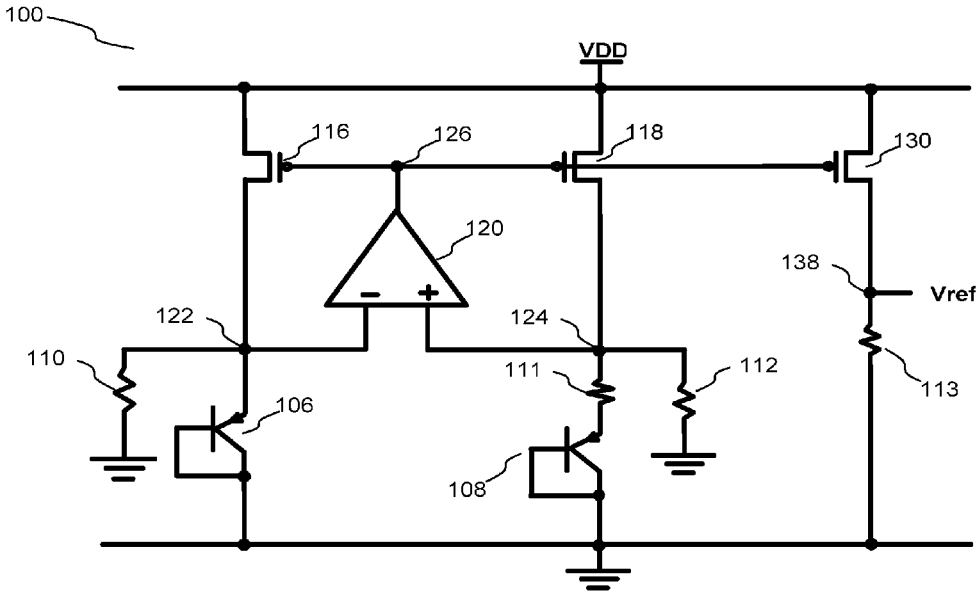
FIG. 1 (Prior Art)
FIG. 1 is a simplified circuit schematic illustrating a conventional sub-bandgap reference generator 100.

FIG. 1 is a simplified circuit schematic illustrating a conventional sub-bandgap reference generator 100. The conventional sub-bandgap reference circuit 100 is configured to use conventional Bi-CMOS technology to create a stable low reference voltage. The conventional bandgap reference circuit 100 comprises two PNP bipolar transistors 106 and 108 with their base terminals coupled to collector terminals, four resistors 110, 111, 112, and 113, three PMOS transistors 116, 118, and 130, a differential amplifier 120.

The base and collector terminals of the two PNP bipolar transistors 106 and 108 are tied to a ground. The emitter of the PNP bipolar transistor 106 is coupled directly to a node 122 and the emitter of the PNP bipolar transistor 108 is coupled to a node 124 through the resistor 111. The sources of the PMOS transistors 116, 118, and 130 are tied to the voltage source, while the drain of the PMOS transistor 116 is coupled to the node 122 and the drain of the PMOS transistor 118 is coupled to the node 124. The gate terminals of the PMOS transistors 116, 118, and 130 are coupled together at a node 126. Resistor 110 is coupled between the node 122 and ground while resistor 112 is coupled between the node 124 and the ground. Resistors 110 and 112 are designed to have equal resistance value. The output resistor 113 is coupled between the drain of the PMOS transistor 130 and the ground.

The node 122 is tied to the negative terminal of the differential amplifier 120 while the node 124 is tied to the positive terminal of the differential amplifier 120. The output of the differential amplifier 120 is coupled to the node 126. The differential amplifier 120 is designed to sense the voltage difference between the node 122 and the node 124 before outputting a regulated voltage at the node 126 to control the PMOS transistors 116, 118, and 130.

A reference voltage is generated by adding two voltages that have temperature coefficients of opposite sign with suitable multiplication constants. The resulting voltages obtained are then independent of temperature. The diode voltage drop across the base-emitter junction, Vbe, of a bipolar junction transistor 106 and 108 changes Complementary-to-Absolute-Temperature (CTAT). Whereas if two bipolar transistors 106 and 108 operate with unequal emitter current densities, for example, due to a resistor 111 coupled between a node 124 and an emitter of the transistor 108 in FIG. 1, then the difference in the base-emitter voltages, ΔVbe, of the transistors is found to be Proportional-To-Absolute-Temperature (PTAT). The PTAT relationship is given by; $\Delta Vbe=V_T \ln m$; $V_T=kT/q$, where k is Boltzmann's constant, T is the absolute temperature, q is the electron charge and m is the ratio of the current densities of the two bipolar transistors. The PTAT voltage may be added to the CTAT voltage with suitable weighting constants to obtain a constant reference voltage.

With the supply voltage applied and the voltage at the node 122 being equal to the emitter-to-base voltage Vbe of the PNP bipolar transistor 106, the voltage at the node 124 will reach a level that is higher than the voltage at the node 122 due to the resistor 111. This allows the differential amplifier 120 to output a regulated signal at the node 126 that will turn on the PMOS transistors 116, 118, and 130. The feedback loop consisting of a differential amplifier 120 and the PMOS transistors 116, 118, and 130 coupled with the voltage source, VDD, forces the voltages at nodes 122 and 124 to be equal. Consequently the current through the resistor 110 is proportional to the built in diode voltage Vbe, and the current through the resistor 111 is proportional to the difference of two built in voltages (ΔVbe). Setting the resistor 110 equal to resistor 112 makes their currents the same. Since the current flowing through the PMOS 118 is the sum of currents through resistors 111 and 112, it will be proportional to $Vbe+\alpha\Delta Vbe$, which is exactly what is needed for a temperature independent reference. This is based on the fact that the two terms in the sum have temperature coefficients of different sign and thus by adjusting the factor α, they can be made to cancel each other. The generated current is mirrored through the resistor 113 producing the reference voltage over the resistor.

As the voltage levels change at both the node 122 and 124 during the operation of the bandgap reference circuit 100, the differential amplifier 120 will continue to sense the voltage difference between the two nodes 122 and 124 to provide a regulated signal at the node 126 to control the PMOS transistors 116, 118, and 130, thereby further adjusting the level of current provided to the nodes 122, 124, and 138. With this type of feedback system implemented, the bandgap reference voltage at the node 138 can be stabilized.

However, the conventional sub-bandgap reference circuit cannot operate at the source voltage, VDD, of lower than 0.9 V because Vbe across the transistor 106 is 0.7 V and the source-drain saturation voltage for the PMOS transistor 116 is around 0.2 V. Accordingly, there is no sufficient room for the conventional bandgap reference circuit to operate under VDD=0.9 V.

Figure 2:
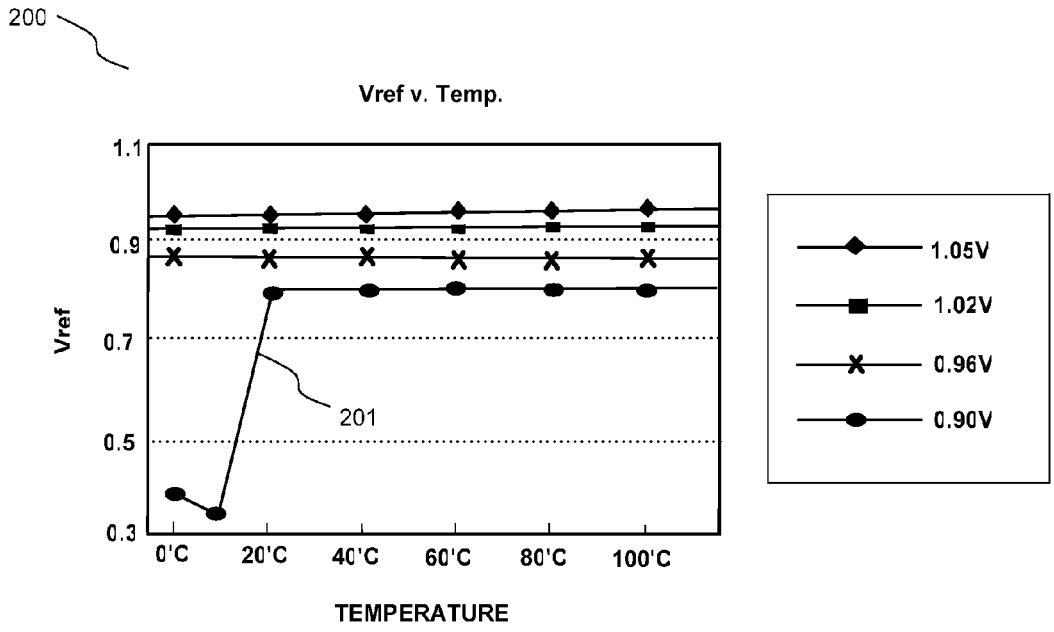
FIG. 2 is a simplified circuit simulation graph 200 showing the performance of the conventional sub-bandgap reference generator circuit.

FIG. 2 is a simplified circuit simulation graph 200 showing the output characteristic of the conventional sub-bandgap reference generator circuit 100. In graph 200, the X-axis represents the temperature and the Y-axis represents the output voltage, Vref, of the conventional sub-bandgap reference generator circuit 100. Vref represents a simulated output potential at node 138 when no DC bias is applied between the emitter and collector terminals of the bipolar transistor 106 and 108. Specifically, the graph identified as 201 represents a simulated output voltage characteristic at the source voltage, VDD, of 0.9 volt in the conventional system 100. As the graph 201 indicates, the conventional bandgap reference circuit does not operate in a stable manner at or lower than 0.9 volt as its output voltage-temperature characteristics degrades at around 0.9 volt. This is because Vbe, the emitter-to-base voltage of the PNP bipolar transistor 106, is typically 0.7 volt and the Vdsat, the source-drain saturation voltage of the PMOS transistor 116, is typically 0.2 volt, a total voltage across the bipolar transistor and the PMOS transistor is only 0.9 V, which renders the conventional system 100 inoperable at a lower VDD level than 0.9 volt. However, recent IC design often requires a lower voltage sub-bandgap reference generator that can operate at lower than 0.9 volt, making this conventional system unsatisfactory to many applications.

Figure 3:
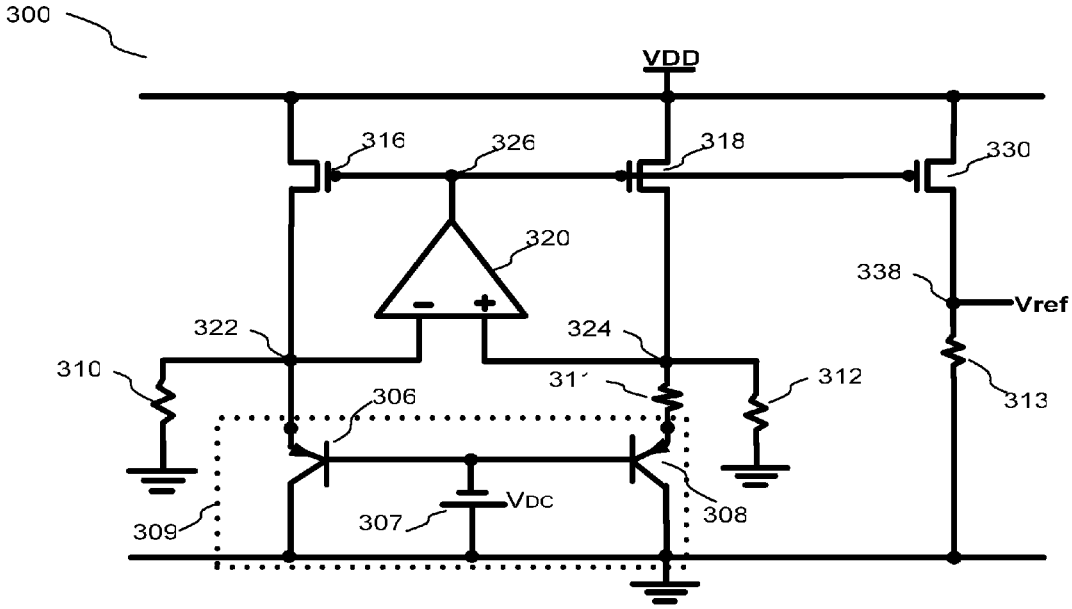
FIG. 3 is a simplified circuit schematic illustrating a sub-bandgap reference generator circuit 300 that is capable of operating at or below 0.9 volt in accordance with an exemplary embodiment of the present invention.

FIG. 3 is a simplified circuit schematic illustrating a sub-bandgap reference generator circuit that is capable of operating at or below 0.9 volt in accordance with an exemplary embodiment of the present invention. The proposed new sub-bandgap reference circuit 300 comprises a conventional bandgap reference generator circuit 100 of FIG. 1 with a negative DC bias, $V_{DC}$, coupled between the base and collector terminals as illustrated by the dashed line 309. Referring to FIG. 3, the DC bias, $V_{DC}$, is applied between the base and collector terminals of both bipolar transistors 306 and 308. In one embodiment, a negative DC bias voltage of 0.1 volt is applied to the base terminals of the bipolar transistors 306 and 308 with reference to the ground to improve the $V_{DDmin}$ characteristic.

Referring back to FIG. 1, where the base terminals of the bipolar transistors 306 and 308 are directly coupled to the ground. As shown in FIG. 3, the embodiment of the present invention proposes instead to bias the base terminals of the bipolar transistors 306 and 308 to a negative voltage with reference to the ground, therefore, the base-emitter voltage of both the bipolar transistors 306 and 308 are increased by the amount of the negative bias voltage. In other words, if the supply voltage VDD drops, the negative DC bias voltage can compensate that VDD drop and maintains the same level of the base-emitter voltage of the bipolar transistors 306 and 308. That is why the embodiment of the present invention can operate at ultra-low VDD.

In an embodiment, a high voltage output terminal and a low voltage output terminal of a DC bias circuit supplying a predetermined voltage output are coupled to a collector terminal and a base terminal of the PNP bipolar transistors 306 and 308 to improve VDDmin characteristic. The bipolar transistors 306 and 308 have the same dimension, topology, and are located closely each other to maintain the same electrical and temperature characteristics. According to a simulation result, the temperature coefficient remains the same at about 2 mV/C even after applying a DC bias of 0.1 volt to the base terminals of the bipolar transistors 306 and 308. Accordingly, the proposed new bandgap reference circuit can improve the low VDD characteristic without adversely affecting the temperature and voltage characteristics of the bandgap reference circuit 100.

Figure 4:
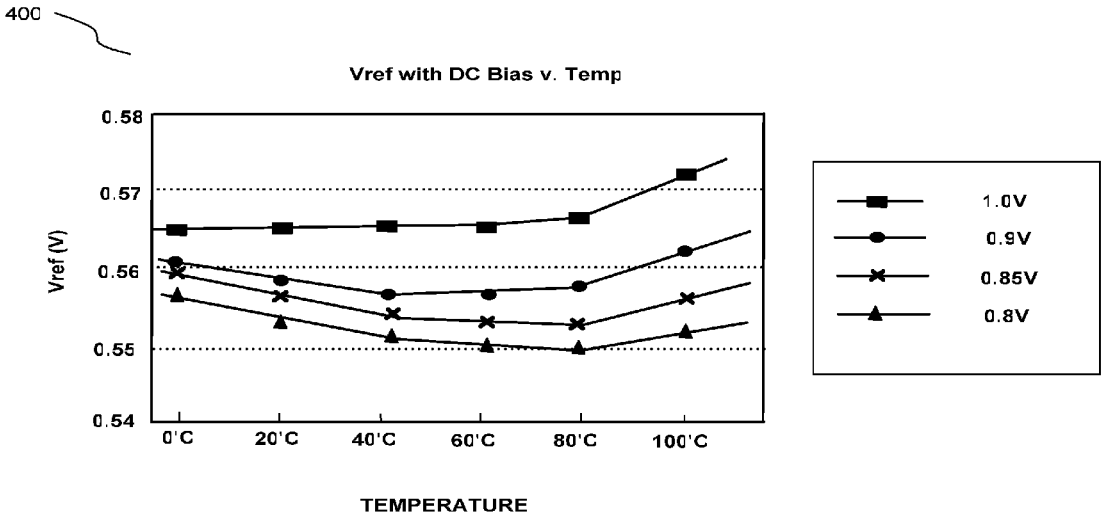
FIG. 4 is a simplified circuit simulation graph 400 showing the performance of the proposed sub-bandgap reference generator.

FIG. 4 is a simplified circuit simulation graph 400 showing the performance of the proposed sub-bandgap reference generator. In graph 400, the X-axis represents the temperature and the Y-axis represents the output reference voltage, Vref, of the low-voltage sub-bandgap reference generator circuit 400 in accordance with an embodiment of the present invention. The Vref represents a simulated output potential at node 338 in the circuit shown in FIG. 3 when a negative DC bias of 0.1 volt is applied to the base terminals with reference to the collector terminals of the bipolar transistor 306 and 308 in FIG. 3. As illustrated in the graph 400, the proposed low-voltage sub-bandgap reference circuit operates at lower voltages than 0.9 volt. Referring to FIG. 4, the proposed circuit can operate at VDD as low as 0.8 volt throughout all the temperature ranges from 0° C. to 100° C. without sacrificing other electrical or temperature-related characteristics.

It should be noted that the proposed sub-bandgap reference generator circuit can be made of different type of bipolar transistors, for example, NPN transistors, as long as the Vbe can be lowered by applying an additional DC bias between the base and collector terminals to improve low VDD characteristic. While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A reference voltage generating circuit, comprising:

a first bipolar transistor having a forward biased emitter-base PN junction diode;

a DC bias circuit supplying a predetermined voltage output between a high and low voltage terminal, the high and low voltage terminal being directly coupled to a collector and a base of the first bipolar transistor, respectively, and a second bipolar transistor being the same type as the first bipolar transistor and having a collector and a base directly coupled to the high and low voltage terminal of the DC bias circuit, respectively.

2. The reference voltage generating circuit of claim 1, wherein the first bipolar transistor is a PNP type bipolar transistor with the collector coupled to an electrical ground.

3. The reference voltage generating circuit of claim 1, wherein the first bipolar transistor is a NPN type bipolar transistor with an emitter coupled to an electrical ground.

4. The reference voltage generating circuit of claim 1 further comprising:

a first resistor serially coupled to the first bipolar transistor at a first node; and a second resistor serially coupled to the second bipolar transistor through a third resistor, the second and the third resistors have a common second node, wherein the first and second resistors have approximately the same resistance and the third resistor has a predetermined resistance in proportion to the resistance of the first and second resistors.

5. The reference voltage generating circuit of claim 4 further comprising a differential amplifier having a first and second input terminal coupled to the first and second node, respectively.

6. A bandgap voltage reference circuit, comprising:

a differential amplifier;

a first bipolar transistor with an emitter coupled to a negative input terminal of the differential amplifier, a collector and a base of the first bipolar transistor being coupled to an electrical ground, thereby forming a first PN junction diode;

a second bipolar transistor with an emitter coupled to a positive input of the differential amplifier through a first resistor, a base and a collector of the second bipolar transistor being coupled to the electrical ground thereby forming a second PN junction diode;

a DC bias circuit supplying a predetermined voltage output between a high and low voltage terminal, the high and low voltage terminal being directly coupled to the collector and base of the first and second bipolar transistors, respectively; and a bandgap reference voltage output module for outputting a bandgap reference voltage.

7. The bandgap voltage reference circuit of claim 6, wherein the first bipolar transistor is a PNP type bipolar transistor.

8. The bandgap voltage reference circuit of claim 6, wherein the first bipolar transistor is a NPN type bipolar transistor with an emitter coupled to the electrical ground.

9. The bandgap voltage reference circuit of claim 6, wherein the first and second bipolar transistors are PNP bipolar transistors with the bases and collectors coupled to the electrical ground.

10. The bandgap voltage reference circuit of claim 6, wherein the second bipolar transistor having a collector and base coupled to the high and low voltage terminal of the DC bias circuit, respectively.

11. The bandgap voltage reference circuit of claim 6, wherein the first and second bipolar transistors have the same topology and dimension.

12. The bandgap voltage reference circuit of claim 6, wherein the bandgap reference voltage output module further comprises:

a first PMOS transistor with a source coupled to a voltage source (VDD) and a gate coupled to an output terminal of the differential amplifier; and a second resistor coupled between the first PMOS transistor and the electrical ground.

13. A bandgap voltage reference circuit comprising:

a differential amplifier;

a first bipolar transistor with an emitter coupled to a negative input terminal of the differential amplifier, a collector and a base of the first bipolar transistor being coupled to an electrical ground thereby forming a first PN junction diode;

a second bipolar transistor with an emitter coupled to a positive input of the differential amplifier through a first resistor, a base and a collector of the second bipolar transistor being coupled to the electrical ground, thereby forming a second PN junction diode;

a DC bias circuit supplying a predetermined voltage output between a high and low voltage terminal, the high and low voltage terminal being directly coupled to the collector and base of the first and the second bipolar transistors, respectively;

a first PMOS transistor with its drain coupled to the negative input terminal and its gate coupled to an output terminal of the differential amplifier;

a second PMOS transistor with its drain coupled to the positive input terminal and its gate coupled to the output terminal of the differential amplifier; and a bandgap reference voltage output module for outputting a bandgap reference voltage.

14. The bandgap voltage reference circuit of claim 13, wherein the first bipolar transistor is a PNP type bipolar transistor with a base and collector terminal coupled to the electrical ground.

15. The bandgap voltage reference circuit of claim 13, wherein the first and second bipolar transistors are PNP bipolar transistors with bases and collectors coupled to the electrical ground.

16. The bandgap voltage reference circuit of claim 13, the second bipolar transistor having a collector and base coupled to the high and low voltage terminal of the DC bias circuit, respectively.

17. The bandgap voltage reference circuit of claim 13, wherein the bandgap reference voltage output module comprises:

a second resistor with its one end coupled to the electrical ground; and a third PMOS transistor with its source coupled to a voltage source (VDD), its gate coupled to the output terminal of the differential amplifier, and its drain coupled another end of the second resistor.

18. A bandgap voltage reference circuit, comprising:

a first bipolar transistor having a first emitter-base PN junction diode;

a second bipolar transistor of the same type as the first bipolar transistor, the second bipolar transistor having a second emitter-base PN junction diode;

a DC bias circuit supplying a predetermined voltage output between a high and low voltage terminal, the high voltage terminal being directly coupled to both collectors of the first and second bipolar transistors and the low voltage terminal being directly coupled to both bases of the first and second bipolar transistors;

a first resistor serially coupled to the first bipolar transistor at a first node; and a second resistor serially coupled to the second bipolar transistor through a third resistor, the second and third resistors have a common second node, wherein the first and second resistors have approximately the same resistance and the third resistor has a predetermined resistance in proportion to the resistance of the first and second resistors.

19. The bandgap voltage reference circuit of claim 18 further comprising a differential amplifier having a first and second input terminal coupled to the first and second node, respectively.

20. The bandgap voltage reference circuit of claim 18 further comprising:

a first current source supplying a first current to the first node; and a second current source supplying a second current to the second node, wherein both the first and second current sources are PMOS transistors with sources coupled to a source voltage (VDD), drains coupled to the first and second node, respectively, and both gates coupled to an output of the differential amplifier.

* * * * *